United States Patent [19]

Neidorff

[11] Patent Number: 4,491,780

[45] Date of Patent: Jan. 1, 1985

[54] TEMPERATURE COMPENSATED VOLTAGE REFERENCE CIRCUIT

[75] Inventor: Robert A. Neidorff, Chandler, Ariz.

[73] Assignee: Motorola, Inc., Schaumburg, Ill.

[21] Appl. No.: 523,482

[22] Filed: Aug. 15, 1983

[51] Int. Cl.[3] ..... G05F 1/58

[52] U.S. Cl. ..... 323/313; 323/907

[58] Field of Search ..... 323/312, 313, 314, 315, 323/316, 907, 266; 307/296 R, 297, 310

[56] References Cited

U.S. PATENT DOCUMENTS

| | | | |
|---|---|---|---|
| 3,617,859 | 11/1971 | Dobkin | 323/313 |
| 3,760,199 | 9/1973 | Graeme | 323/907 X |
| 3,886,435 | 5/1975 | Steckler | 323/907 X |
| 3,893,018 | 7/1975 | Marley | 323/313 |
| 3,908,162 | 9/1975 | Marley et al. | 323/907 X |
| 4,335,346 | 6/1982 | Streit | 323/907 X |
| 4,368,420 | 1/1983 | Kuo | 323/907 X |

OTHER PUBLICATIONS

Chung C. Liu, "Temperature Compensated Voltage Reference Source", IBM Tech. Discl. Bulletin, vol. 14, No. 4, Sep. 1971, pp. 1223–1224.

*Primary Examiner*—Peter S. Wong

*Attorney, Agent, or Firm*—Michael D. Bingham

[57] ABSTRACT

A monolithic integrated temperature compensated voltage reference circuit that includes a thermal source circuit for producing a current at an output thereof having a positive temperature coefficient and an output circuit coupled to the thermal source circuit which is responsive to this current for establishing an output voltage having a substantially zero temperature coefficient associated therewith.

7 Claims, 3 Drawing Figures

TEMPERATURE COMPENSATED VOLTAGE REFERENCE CIRCUIT

BACKGROUND OF THE INVENTION

The present invention relates to solid state integrated band-gap type voltage reference circuits. More particularly, this invention relates to band-gap reference circuits wherein the output voltage can be made any multiple of the band-gap voltage in which the output voltage remains substantially constant with temperature variation.

Solid state band-gap references are well known to those skilled in the art which rely on certain temperature dependent characteristics of the base-emitter voltage (VBE) of a bipolar transistor. For example, U.S. Pat. No. 3,617,859 describes such a band-gap reference wherein the negative temperature coefficient of the base-to-emitter voltage of a first transistor in conjunction with the positive temperature coefficient of the base-to-emitter voltage differential between two additional transistors operating at different current densities is used to achieve a zero temperature coefficient reference potential.

Another voltage reference circuit of the type referred to incorporates four transistors which are interconnected, with respective pairs of the transistors having ratioed emitter areas to establish a difference voltage across a reference resistor having a positive temperature coefficient. This positive temperature coefficient voltage across the reference resistor can be used to negate the negative temperature coefficient of the base-to-emitter voltage of another transistor. This particular reference circuit is shown and described in U.S. Pat. No. 3,908,162.

Although prior art voltage reference circuits based on the $V_{BE}$ characteristics of transistors and discussed above have advantages associated therewith, these types of circuits suffer from some limitations. For instance, these circuits may suffer on accuracy and TC compensation as well as having beta dependent characteristics which are not desired. Therefore, there is a need for an improved temperature compensated voltage reference circuit which overcomes the aforementioned limitations as well as having superior load rejection characteristics. In addition such improved circuit would desirably have load driving capability.

SUMMARY OF THE INVENTION

Accordingly, it is an object of the present invention to provide an improved voltage reference circuit.

Another object of the present invention is to provide an improved solid state voltage reference circuit.

Still another object of the invention is to provide an improved solid state band-gap voltage reference wherein the reference voltage has a value that can be made any integral multiple of the band-gap voltage below the positive power supply conductor rail.

A further object is to provide a solid state band-gap voltage reference having both a low temperature coefficient associated therewith and load rejection capability.

In accordance with the above and other objects there is provided a temperature compensated voltage reference comprising a thermal source circuit responsive to a first or initial current for producing a second current at an output having a predetermined temperature coefficient and further including an output circuit responsive to the second current which produces a temperature compensated voltage at an output thereof.

DETAILED DESCRIPTION OF THE PREFERRED EMBODIMENTS

Figure 1:
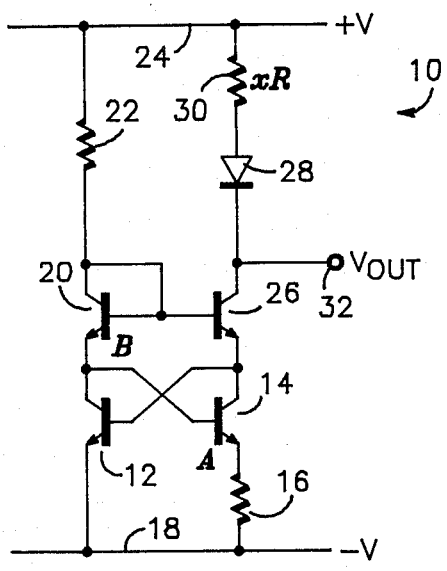
FIG. 1 is a schematic diagram illustrating the temperature compensated voltage reference of a first embodiment of the present invention.

Turning to FIG. 1 there is shown temperature compensated voltage reference 10 of the present invention. Reference 10 is suited to be manufactured in monolithic integrated circuit form. Reference 10 includes a thermal source circuit comprising cross-connected NPN transistors 12 and 14 which are interconnected with NPN transistors 16 and 18 as well as resistor 20. A first current I1 is produced through resistor 22, which is connected between power supply conductor 24 to an input of the thermal source circuit. Assuming the transistors have a high beta (current amplification factor), to the first order, base current errors can be neglected such that ideally the current I1 flows through the collector-emitter conduction path of diode connected transistor 16 and the collector-emitter conduction path of transistor 12 to power supply conductor 26.

Current I1 flowing through diode 16 and, thus, transistor 12 establishes a current I2 to flow through the collector-emitter conduction path of transistor 18 as the base of transistor 18 is connected to diode 16. This current I2 flows from the output of the thermal source circuit (at the collector of transistor 18) through the collector-emitter of transistor 14 and through resistor 20. The base of transistor 12 is cross coupled to the collector of transistor 14 and vice-versa such that a $\Delta V_{BE}$ voltage is developed across the resistor. The magnitude of $\Delta V_{BE}$ is equal to $(I2 \cdot R_{20})$. As illustrated, transistors 14 and 16 are emitter area ratioed with respect to transistors 12 and 18 such that a different current density is established through the respective transistors. This causes a positive temperature coefficient voltage to be developed across resistor 20 as is well understood. The magnitude and temperature dependent characteristics of current I2 can be found by writing the voltage loop equation around the transistor circuit loop formed by the thermal source circuit. Thus, it can be shown that:

$$V_{BE16} + V_{BE14} + I_2 R_{20} = V_{BE18} + V_{BE12} \quad (1)$$

substituting the well known diode-current expression for each $V_{BE}$ term of equation 1 and rearranging yields the following:

$$I_2 = \frac{kT}{qR_{20}} \times \ln (AB) \quad (2)$$

Equation 2 shows that the current $I_2$ flowing at the output of the thermal source circuit has a predetermined positive temperature coefficient and has a magnitude that is a factor of the emitter area ratios A and B.

Current $I_2$ is sourced through an output circuit comprising diode 28 and resistor 30 which are series connected between power supply conductor 24 and node 32. The positive temperature coefficient of the resulting voltage developed across resistor 30 cancels the negative temperature coefficient of the voltage of diode 28 to produce an output voltage, $V_{OUT}$, at output terminal 34 of voltage reference 10 that has a substantially zero temperature coefficient.

In general, $V_{OUT}$ can be made any multiple of the band-gap voltage, 1.2 volts below +V by changing the value of resistor 30 simultaneously with adding or decreasing the number of diode series connected therewith. For instance, if two diodes are series connected to node 32, resistor 30 would be doubled in value.

Figure 2:
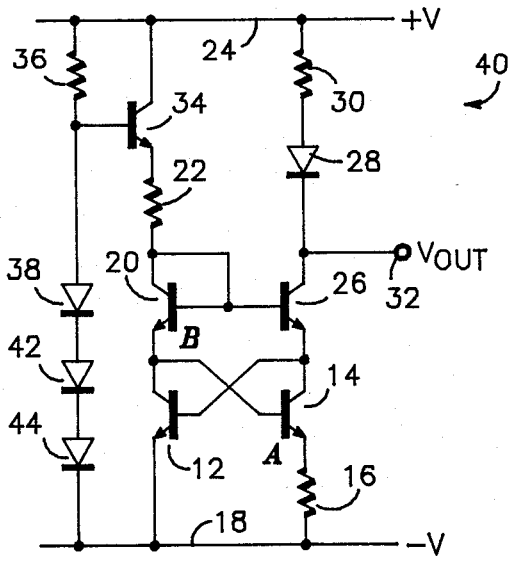
FIG. 2 is a schematic diagram illustrating a temperature compensated voltage reference of a second embodiment of the invention.
Figure 3:
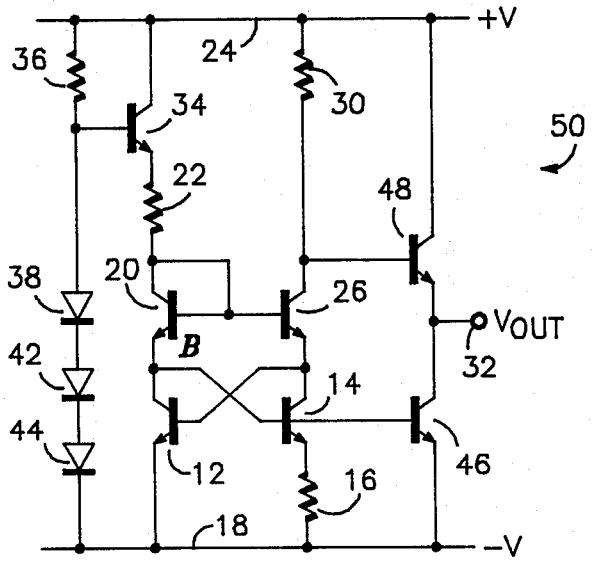
FIG. 3 is a schematic diagram illustrating a temperature compensated voltage reference of an additional embodiment of the invention.

Referring now to FIGS. 2 and 3 there are illustrated voltage references comprising the thermal source circuit described above. Therefore, circuit components illustrated in FIGS. 2 and 3 corresponding to like components in FIG. 1 are indicated with the same reference numerals.

Voltage reference 40 of FIG. 2 enjoys improved thermal rejection over voltage reference 10. A preregulator circuit comprising resistor 36 series connected with diodes 38, 42 and 48 between power supply conductors 24 and 26 provides a voltage level at the interconnection between resistor 36 and the anode of diode 38 which is substantially proportional to absolute temperature by the same equations as shown above. The positive temperature coefficient of the voltage developed across resistor 22 due to the present circuit configuration, including the preregulator, helps reduce or inhibit variations in the output that might otherwise occur due to higher order base current error effects. Hence, the overall effect of voltage reference 40 is to provide a temperature regulated output voltage having better temperature compensation and regulation over that of the voltage reference 10.

Voltage reference 50 illustrated in FIG. 3 not only enjoys the better performance described above in reference to the voltage reference circuit of FIG. 2 but also provides improved output impedance and load rejection characteristics with respect to either reference 10 or reference 40. Moreover, voltage reference 50 has the additional advantage of being able to supply large drive currents at output 34.

As illustrated, resistor 30 is connected between power supply conductor 24 and node 32 with output 34 being taken at the emitter of the emitter follower transistor 48, the base of which is connected to node 32. Transistor 52 has its collector-emitter path connected between the emitter of transistor 48 and power supply conductor 26 and its base connected to the base of transistor 14 wherein the collector current of this transistor is mirrored with respect to output current $I_2$ of the thermal source circuit.

The voltage drop across resistor 30 is amplified up from the voltage drop developed across resistor 20 and has a positive temperature coefficient associated therewith as aforedescribed. However, when the voltage drop across resistor 30 is added with the negative temperature coefficient base-emitter voltage of transistor 48, a substantially zero temperature coefficient output voltage is developed at output 34 wherein the magnitude is approximately one band-gap voltage drop below the voltage supplied at power supply conductor 24.

What has been described above is an all NPN temperature regulated band-gap voltage reference. The voltage reference is comprised of a thermal source circuit including cross-coupled and interconnected emitter area ratioed transistor pairs for producing an output current having a positive temperature coefficient which is utilized by an output circuit in conjunction with the negative temperature coefficient of a PN junction to establish a temperature compensated output voltage.

I claim:

1. Temperature compensated, integrated voltage reference circuit, comprising:

thermal source circuit means having an input and an output which is responsive to a first current supplied to said input for causing a second current having a positive temperature coefficient to flow into said output including first and second transistors each having a control electrode, first and second electrodes, said control electrodes being cross coupled to the second electrode of other one of said first and second transistors, said first electrodes of said first transistor and said second transistor being respectively coupled directly and indirectly to a first power supply conductor; first semiconductor diode means coupled between said input of said thermal source circuit means and said second electrode of said first transistor; and a third transistor having a control electrode, first and second electrodes, said control electrode being coupled to said semiconductor diode means, said first electrode being coupled to said second electrode of said second transistor, and said second electrode being coupled to said output of said thermal source circuit means, and output circuit means coupled to said output of said thermal source circuit means and responsive thereto for supplying said second current and for producing a voltage at an output thereof having a substantially zero temperature coefficient.

2. The voltage reference circuit of claim 1 wherein said output circuit means includes:

second semiconductor diode means; and first resistor means series connected with said second semiconductor diode means between said output of said thermal source circuit means and a second power supply conductor.

3. The voltage reference circuit of claim 2 including preregulator means comprises:

second resistive means;

third semiconductor diode means in series connection with said second resistive means between said first and second power supply conductor means;

a fourth transistor having a control electrode, first and second electrodes, said control electrode being coupled to the interconnection between said second resistive means and said third semiconductor diode means, said second electrode being coupled to said second power supply conductor; and third resistive means coupled between said first electrode of said fourth transistor and said first semiconductor diode means.

4. The voltage reference circuit of claim 3 wherein said thermal source circuit means further includes a third resistive means coupled between said second electrode of said second transistor and said first power supply conductor.

5. The voltage reference circuit of claim 1 wherein said output circuit means includes:

first resistive means coupled between a second power supply conductor and said output of said thermal source circuit means;

a fourth transistor having a control electrode, first and second electrodes, said control electrode being connected to said output of said thermal source circuit means, said first electrode being coupled to an output of the voltage reference circuit, and said second electrode being coupled to said second power supply conductor; and a fifth transistor having a control electrode, first and second electrodes, said control electrode being coupled to said control electrode of said second transistor, said first electrode being coupled to said first power supply conductor, and said second electrode being coupled to said output of the voltage reference circuit.

6. The voltage reference circuit of claim 5 including preregulator means comprising:

second resistive means, second semiconductor diode means in series connection with said second resistive means between said first and second power supply conductors;

a sixth transistor having a control electrode, first and second electrodes, said control electrode being connected to the interconnection between said second resistive means and said second semiconductor diode means, said second electrode being coupled to said second power supply conductor; and third resistive means coupled between said first electrode of said sixth transistor and said input of said thermal source circuit means.

7. The voltage reference circuit of claim 6 wherein said thermal source circuit means includes fourth resistor resistive means connected between the said first electrode of said second transistor and said first power supply conductor.

* * * * *